US007648093B2

(12) United States Patent
Kruger

(10) Patent No.: US 7,648,093 B2
(45) Date of Patent: Jan. 19, 2010

(54) PILL CRUSHER AND PILL POUCH

(76) Inventor: Dennis Kruger, 33050 Whidden Ave., Mission, British Columbia (CA) V2V 2T2

( * ) Notice: Subject to any disclaimer, the term of this patent is extended or adjusted under 35 U.S.C. 154(b) by 31 days.

(21) Appl. No.: 11/727,552

(22) Filed: Mar. 27, 2007

(65) Prior Publication Data

US 2008/0237381 A1 Oct. 2, 2008

(51) Int. Cl.
*B02C 19/08* (2006.01)

(52) U.S. Cl. ..... 241/169; 241/169.1; 241/169.2; 241/DIG. 27

(58) Field of Classification Search ..... 241/DIG. 27, 241/169.1, 169.2, 169, 262
See application file for complete search history.

(56) References Cited

U.S. PATENT DOCUMENTS

| | | | |
|---|---|---|---|
| 2,548,599 | A | 4/1951 | Garr |
| 2,886,253 | A | 5/1959 | Skibicki et al. |
| 3,091,337 | A | 5/1963 | Nordell |
| 4,366,930 | A | 1/1983 | Trombetti, Jr. |
| 4,486,330 | A | 12/1984 | Yoshida et al. |
| D285,966 | S | 9/1986 | Porter |
| 4,620,185 | A | 10/1986 | Plahmer |
| 4,694,996 | A | 9/1987 | Siegel |
| D310,564 | S | 9/1990 | Besaw |
| 4,988,046 | A | 1/1991 | Heilenz |
| 5,025,996 | A | 6/1991 | Lavin et al. |
| 5,061,318 | A | 10/1991 | Casey et al. |
| 5,067,666 | A | 11/1991 | Sussman |
| 5,123,601 | A | 6/1992 | Lavin et al. |
| 5,164,008 | A | 11/1992 | Casey et al. |
| 5,178,337 | A | 1/1993 | Lupoli |
| D337,828 | S | 7/1993 | Gordon |
| 5,322,227 | A | 6/1994 | Fiocchi |
| 5,376,072 | A | 12/1994 | Klearman et al. |
| 5,398,643 | A | 3/1995 | McElrath et al. |
| 5,464,393 | A | 11/1995 | Klearman et al. |
| 5,472,421 | A | 12/1995 | Klearman et al. |
| 5,531,386 | A | 7/1996 | Jensen |
| 5,571,820 | A | 11/1996 | Ohuchi et al. |
| 5,718,681 | A | 2/1998 | Manning |
| 5,733,173 | A | 3/1998 | Whittle et al. |
| 5,766,623 | A | 6/1998 | Ayres et al. |
| 5,823,451 | A | 10/1998 | Sharpe |
| 5,863,001 | A | 1/1999 | Schulze |
| D405,889 | S | 2/1999 | Parsons |
| 5,915,637 | A | 6/1999 | Parsons |
| 5,924,636 | A | 7/1999 | Calderon |
| 6,059,209 | A | 5/2000 | Barson |

(Continued)

FOREIGN PATENT DOCUMENTS

| | | |
|---|---|---|
| CA | 2447753 | 5/2003 |

(Continued)

*Primary Examiner*—Mark Rosenbaum

(57) ABSTRACT

A pill crusher has a ram and an anvil member having opposed pill crushing faces, and an electric ram drive operable to displace the ram towards the anvil member. The anvil member is rotatable and displaceable in response to pressure from the ram, to ensure the crushing of a pill located between the crushing faces of the ram and the anvil member. The anvil member, the ram and the ram drive are provided in a housing having a pill pouch reception opening which is upwardly open and extends above the crushing face of the anvil member.

11 Claims, 6 Drawing Sheets

U.S. PATENT DOCUMENTS

| | | | | |
|---|---|---|---|---|
| D433,148 | S | 10/2000 | Dennis | |
| 6,191,205 | B1 | 2/2001 | Micouin et al. | |
| 6,308,704 | B1 | 10/2001 | Wennerberg | |
| 6,357,679 | B1 | 3/2002 | Radke | |
| 6,508,424 | B1 | 1/2003 | Marshall | |
| 6,523,766 | B1 | 2/2003 | Watt | |
| 6,616,075 | B1 | 9/2003 | Millerd | |
| 6,622,949 | B1 | 9/2003 | Baswick et al. | |
| 6,637,683 | B1 | 10/2003 | Wilbur | |
| 6,637,685 | B1 | 10/2003 | Kruger | |
| 6,690,590 | B2 | 2/2004 | Stamenic et al. | |
| 7,032,851 | B2 | 4/2006 | Demske et al. | |
| 7,175,578 | B2 * | 2/2007 | Elkis et al. | 483/16 |
| 7,300,006 | B2 * | 11/2007 | Weisbeck | 241/63 |
| 7,413,137 | B2 * | 8/2008 | Donovan | 241/168 |
| 2006/0043225 | A1 | 3/2006 | Peron et al. | |

FOREIGN PATENT DOCUMENTS

| | | |
|---|---|---|
| CA | 2401933 | 3/2004 |
| CH | 671891 | 10/1989 |
| GB | 467537 | 6/1937 |
| JP | 1007959 | 1/1989 |
| JP | 2003053208 | 2/2003 |
| JP | 2003053211 | 2/2003 |
| JP | 2004290795 | 10/2004 |

* cited by examiner

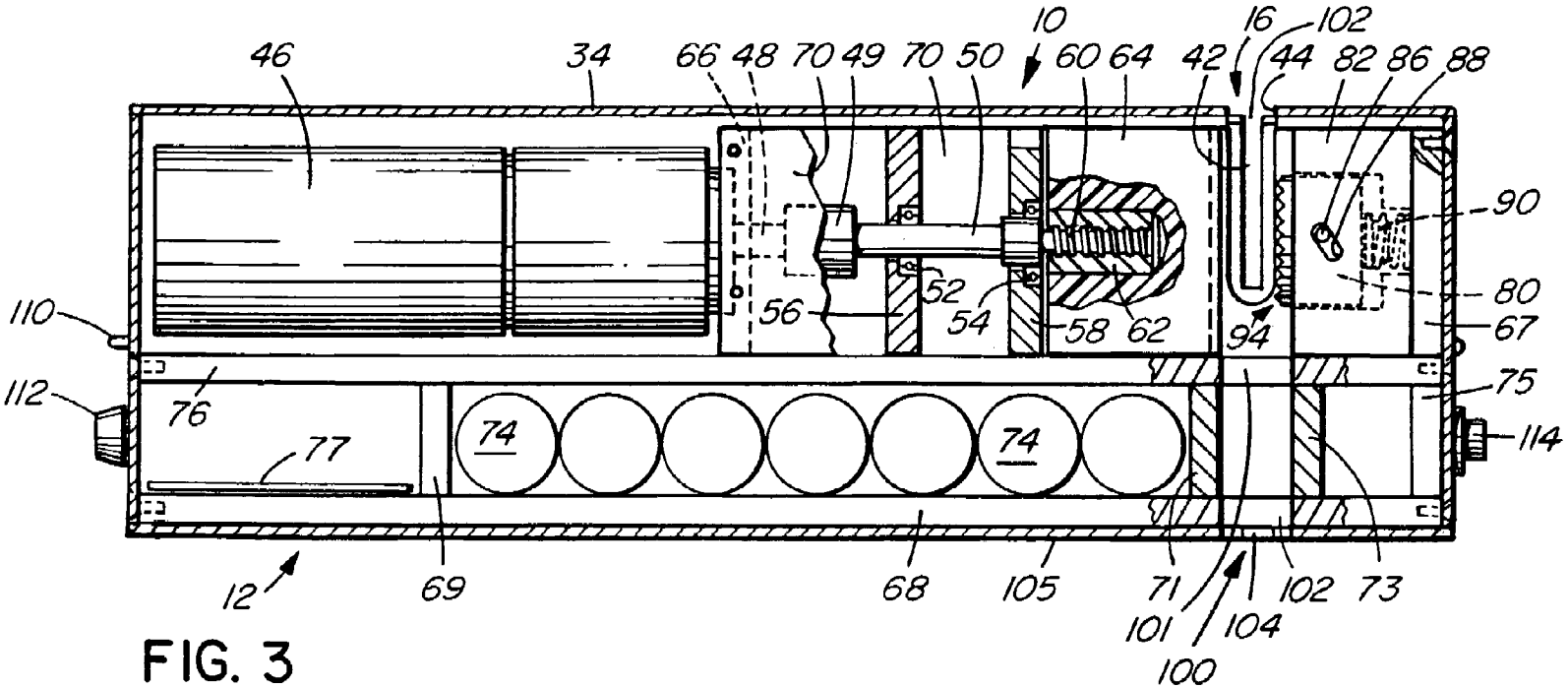
FIG. 3
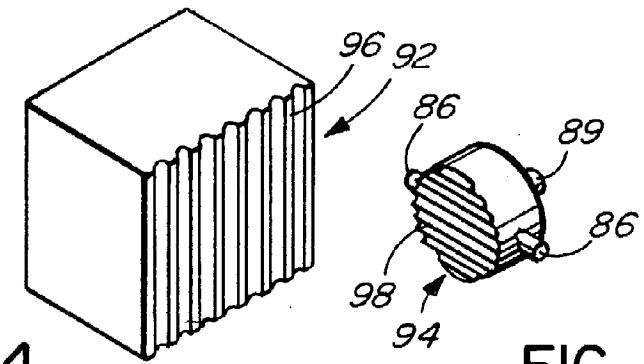
FIG. 4
FIG. 5

PILL CRUSHER AND PILL POUCH

BACKGROUND OF THE INVENTION

1. Field of the Invention

The present invention relates to a pill crusher and to a pill pouch for containing a pill while the pill is being crushed.

2. Description of the Related Art

For elderly patient in hospitals and care homes, there is a need to crush pills being fed to the patients so that the patients will not choke on the pills. Often, the crushed pills are mixed with apple sauce or the like in a paper cup before being fed to the patients.

To facilitate the crushing of the pills, pill crushers are mounted on trolleys used by nursing staff in the hospitals and care homes to carry medications and other supplies to the patients.

Previously, the pill crushers have usually been of a manually actuated type, which are awkward and time consuming to operate. To avoid these difficulties, it has previously been proposed to provide electrically operated pill crushers, but these have been found to be unreliable in operation and/or too bulky to provide satisfactory use in practice.

BRIEF SUMMARY OF THE INVENTION

According to the present invention, there is provided a pill crusher, comprising a ram and an anvil member having opposed pill crushing faces, and an electric ram drive operable to displace the ram towards the anvil member. The anvil member is rotatable and displaceable in response to pressure from the ram, to ensure the crushing of a pill located between the crushing faces of the ram and the anvil member. The anvil member, the ram and the ram drive are provided in a housing having a pill pouch reception opening which is upwardly open and extends above the crushing face of the anvil member.

In use of the present pill crusher, at least one pill to be crushed is inserted into a pill pouch, and the pill pouch is then inserted into the pill pouch reception opening to locate a portion of the pill pouch containing the pill between the crushing faces of the ram and the anvil member. The electric ram drive is then energised to cause the ram to be displaced towards the anvil member, so that this portion of the pill pouch and the pill are compressed between the crushing faces of the ram and the anvil member. In response to the pressure thereby transmitted from the ram through the portion of the pill pouch and the pill to the anvil member, the latter is caused to be displaced and simultaneously rotated. This ensures that the pill is not only compressed between the crushing faces of the ram and the anvil member but is also ground between these faces by the rotation of the anvil member, so that thorough pulverization of the pill is ensured.

BRIEF DESCRIPTION OF THE DRAWINGS

The invention will be more readily understood from the following description of an embodiment thereof given, by way of example only, with reference to the accompanying drawings, in which:

FIG. 3 shows a view taken in vertical longitudinal cross-section through the pill crusher of FIG. 1;

FIG. 4 shows a view in perspective of a ram forming part of the pill crusher of FIG. 1;

FIG. 5 shows a view in perspective of an anvil member forming part of the pill crusher of FIG. 1;

DESCRIPTION OF THE PREFERRED EMBODIMENT

Figure 1:
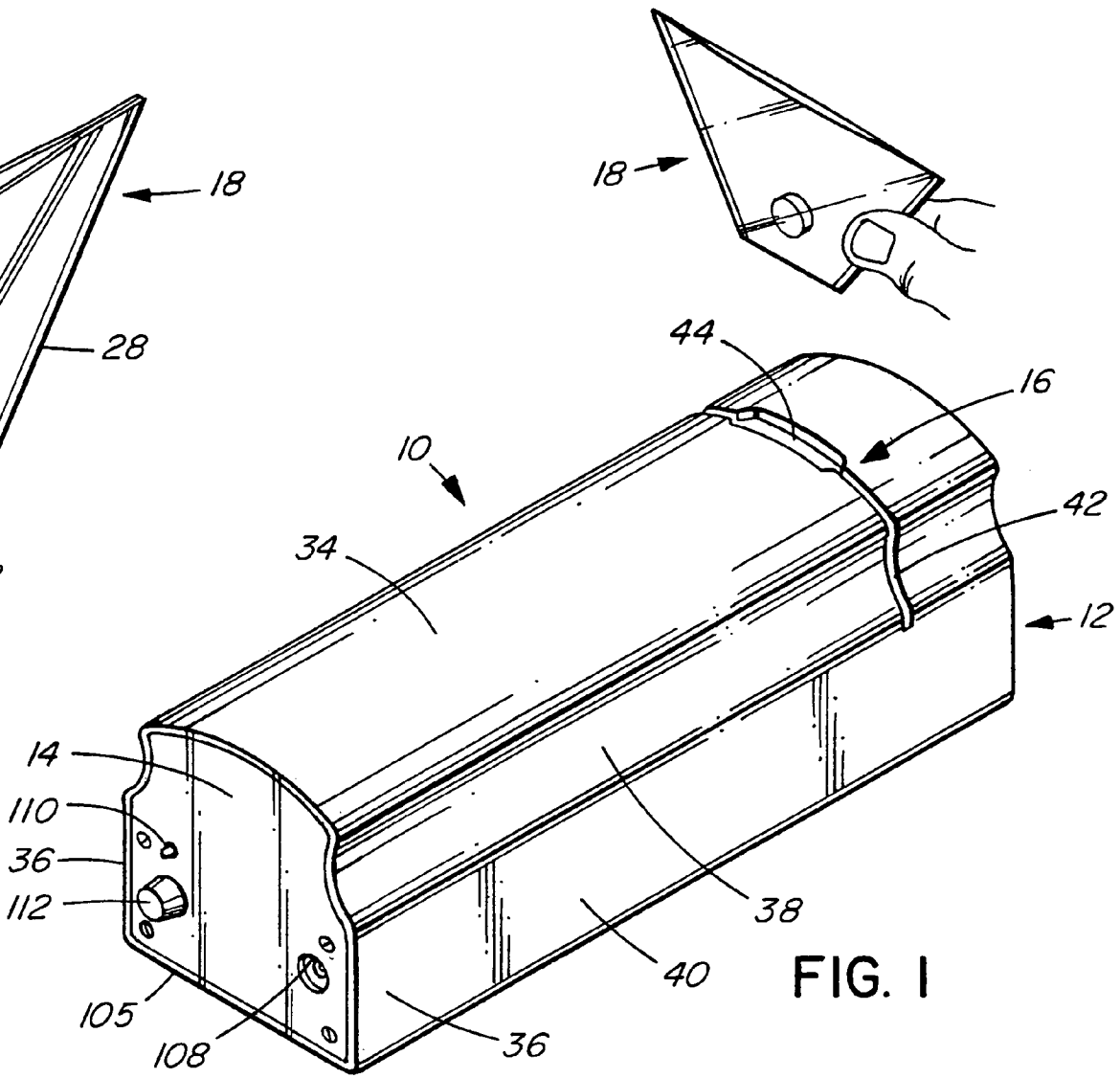
FIG. 1 shows a view in perspective of a pill crusher according to a preferred embodiment of the present invention.

In the accompanying drawings, a pill crusher according to a preferred embodiment of the invention is indicated generally by reference numeral 10, and has a housing, which is indicated generally by reference numeral 12 and which is formed as an extrusion of aluminum closed at opposite ends by end plates 14 and 15. Instead of being made of aluminum, the housing 12 may be formed of any other suitable material, e.g. plastic material.

Figure 2:
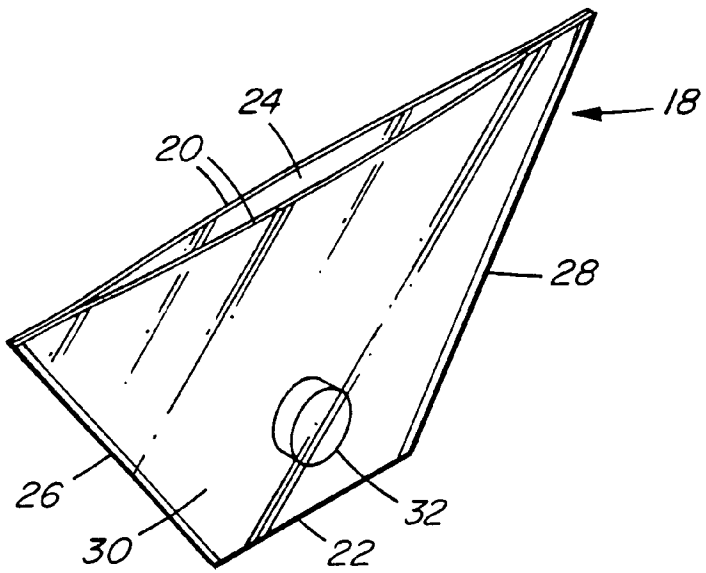
FIG. 2 shows a view in perspective of a pill pouch for use in the pill crusher of FIG. 1.

The housing 12 is provided with a pill pouch reception opening indicated generally by reference numeral 16 for receiving a pill pouch indicated generally by reference numeral 18 in FIGS. 1 and 2.

As shown in FIG. 2, the pill pouch 18 is formed by two layers 20 of transparent plastic material which, in the present embodiment, are formed from a single sheet of material folded in half along a fold line 22 to form one edge of the pill pouch 18. The pill pouch 18, which has a trapezoidal shape as shown, is open at a first side 24, which as illustrated in FIG. 2 is the top of the pill pouch 18, the fold line 22 forming a second side opposite from the first side 24. Between its opposite first and second sides, the pill pouch 18 has edges 26 and 28 at which the edges of the layers 20 are welded together. The edges 26 and 28 are inclined towards one another and towards the fold line 22 so as to define a pill reception area 30 within the pouch 18 and adjacent the fold line 22.

The inclined edges 26 and 28 serve to guide a pill 32 into the pill reception area 30 on insertion of the pill 32 into the pill pouch 18 through the pouch opening at the first side 24 of the pill pouch 18.

The housing 12 is formed with a transversely convex top portion 34 and opposite side portions indicated generally by reference numerals 36, and in the present embodiment the side portions 36 each comprise a transversely concave portion 38 and a substantially flat lower portion 40. The concave portions 38 merge smoothly with the top portion 34 and with the substantially flat lower portion 40, and serve to facilitate manual gripping of the housing 12 when the pill crusher 10 is lifted.

The pill pouch reception opening 16 is formed as a slot 42 which, as shown in FIGS. 1 and 3, extends transversely of the housing 12 over the top portion 34 of the housing 12 and through the concave portions 38 of the opposite side portions 36 of the housing 18. At the top portion 34 of the housing 12, the slot 42 has a widened section 44 of a size sufficient to allow the pill reception area 30 of the pill pouch 18, together with the pill 32 in the pill reception area 30, to pass through the top portion 34 into the interior of the housing 10.

Referring now to the longitudinal cross-sectional view of the pill crusher 10 shown in FIG. 3, there is shown an electric ram drive comprising an electric motor 46 having an output shaft 48 connected by a coupler 49 to a shaft 50, which is rotatable in a radial bearing 52 and a thrust bearing 54, mounted in support plates 56 and 58, the shaft 50 having an end portion formed as a lead screw 60.

The lead screw 60 is in threaded engagement with a metal insert 62 in a ram 64, and the ram 64 is formed as a plastic material block of square cross-section.

The support plates 56 and 58, and a further support plate 67, are connected by screws (not shown) to a pair of rectangular side plates 70 extending longitudinally along the interior of the housing 12 at opposite sides of the housing 12.

Figures 8, 8A, 8B, 8C, 8D:
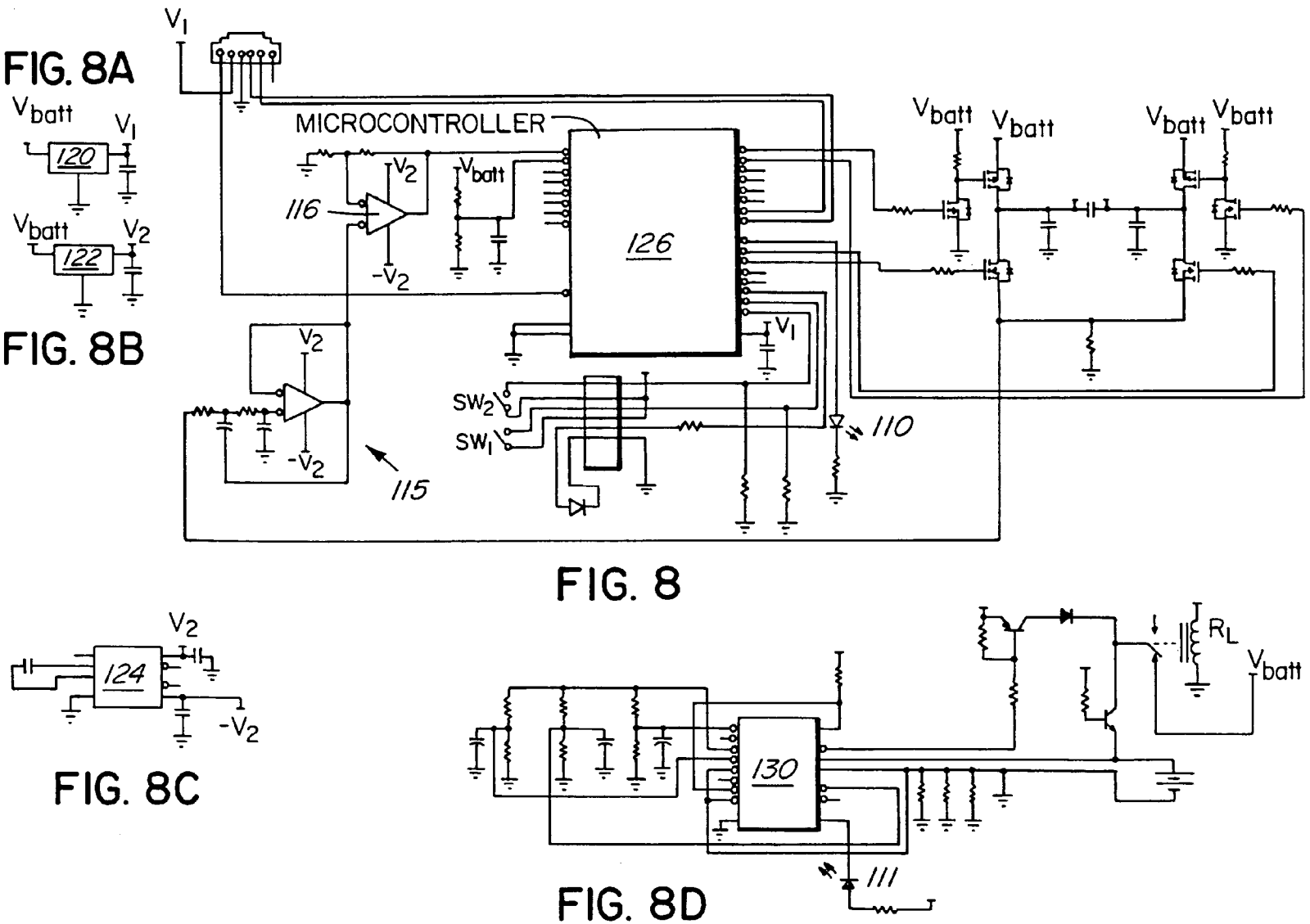
FIG. 8 shows a circuit diagram of a control circuit included in the pill crusher of FIG. 1.

Along the lower portion of the interior of the housing 12 extends a tray, which is formed by a base plate 68 and partition plates 69, 71, 73 and 75 extending between the base plate 68 and a horizontal rectangular plate 76, and which contains batteries 74 and a printed circuit board 77 containing a control circuit, which is illustrated in greater detail in FIG. 8.

The block of square cross-section, forming the ram 64, is slidable in the longitudinal direction of the lead screw 60, but is prevented from rotating by the side plates 70 and the horizontal rectangular plate 76, the plates 70 and 76 each slidably contacting faces of the ram 64. Consequently, when the electric motor 46 is energised to rotate the lead screw 60, the ram 64 is displaced longitudinally of the housing 12 by the lead screw 60.

In alignment with the ram 64, an anvil member 80 is movably mounted in a support block 82, which abuts the support plate 67 to which the end plate 15 is secured. The anvil member 80 is of cylindrical shape and, as shown in FIG. 5, is provided, on opposite sides of the anvil member 80, with laterally projecting pins 86. The pins 86 slidably engage in inclined slots, of which only one is shown and is indicated by reference numeral 88 in FIG. 3. The anvil member 80 is urged to the left, as viewed in FIG. 3, into the position in which it is shown in FIG. 3, by a helical compression spring 90 acting between the support plate 67 and the anvil member 80. A cylindrical projection 89 on the anvil member 80 projects between the coils of the helical compression spring 90.

The ram 64 and the anvil member 80 have opposed crushing faces, which are indicated generally by reference numerals 92 and 94, and which are formed with serrations 96 and 98 to grind the pill 32, as described in greater detail below.

As can be seen from FIG. 3, the pill pouch reception opening 16 in the top portion 34 of the housing 12 extends adjacent the spacing between the crushing face 92 and 94 of the ram 64 and the anvil member 80. Consequently, when the pill pouch 18 is inserted into the pill pouch reception opening 16, the pill 32, located in the pill reception area 30 of the pill pouch 18, becomes positioned between the crushing faces 92 and 94.

Figure 6:
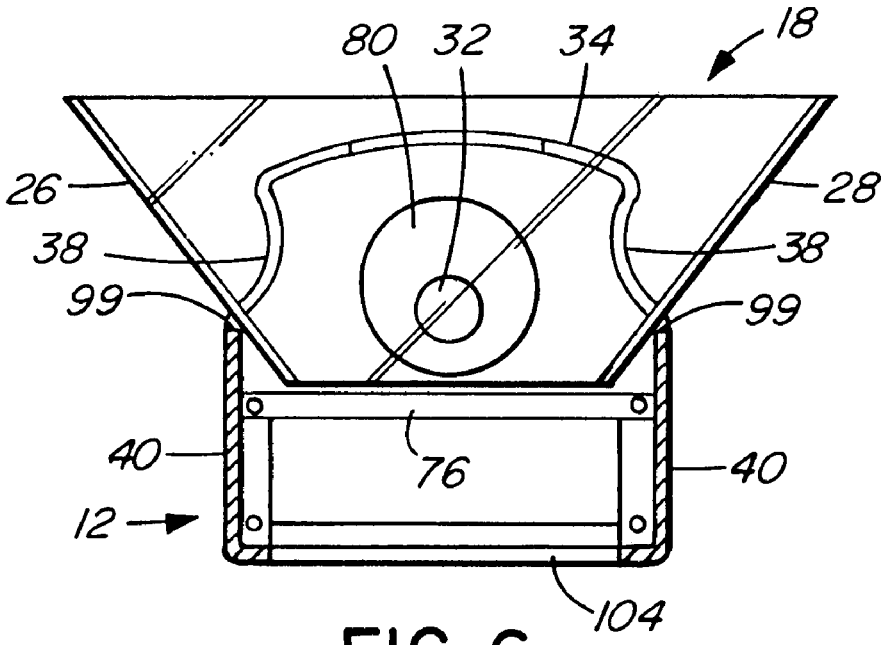
FIG. 6 show a view taken in cross-section along the line 6-6 of FIG. 3 and showing the pill pouch of FIG. 2 inserted into the pill crusher.
Figure 7:
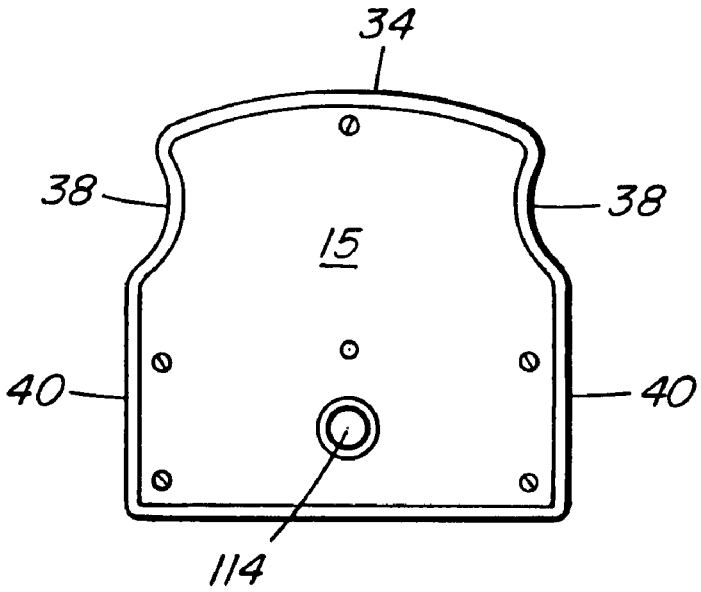
FIG. 7 shows a view in end elevation of the pill crusher of FIG. 1.

More particularly, as shown in FIG. 6, when the pill pouch 18 is inserted downwardly into the pill pouch reception opening 16, the downward movement of the pill pouch 18 relative to the housing 12 is limited by contact of the inclined edges 26 and 28 of the pill pouch 18 with opposite ends 99 of the slot 42. The length of the slot 42 therefore determines the extent to which the pill pouch 18 can move downwardly into the housing 12 so as to ensure that the pill reception area 30 is correctly positioned between the crushing faces 92 and 94.

As shown in FIG. 3, the pill pouch reception opening 16 is located above a waste outlet passage indicated generally by reference numeral 100, which extends through a slot 101 in the plate 76, between the partition plates 71 and 73 and through a slot 104 in a bottom portion 105 of the housing 12. The waste outlet passage 100 allows portions of the pill 32, which may escape from the pill pouch 18 if the pill pouch 18 becomes ruptured, to fall though and from the pill crusher 10.

The end plate 14, as shown in FIG. 1, is provided with an opening 108 for receiving a connector (not shown) of a battery charger (not shown) for recharging the batteries 74, a LED 110 for indicating the charging of the batteries and a fuse 112.

The opposite end plate 15 has an actuating button 114 (FIG. 3) for initiating the operation of the control circuit of FIG. 8.

The circuitry provided on the printed circuit board 77 is illustrated in FIGS. 8-8D.

FIGS. 8A and 8B show voltage regulators comprising microchips 120 and 122 for outputting voltages of $V_1$ and $V_2$, respectively, in response to the voltage $V_{batt}$ of the batteries 74, to a control circuit shown in FIG. 8 and to a charge pump shown in FIG. 8C, which comprises a microchip 124 and provides a output $-V_2$.

The control circuit of FIG. 8 comprises a microcontroller 126 (PIC 18F2420) controlling the energization of the ram motor 46. The voltages regulated by the voltage regulators of FIGS. 8A and 8B and the charge pump of FIG. 8C, are applied to the terminals $V_1$, $V_2$, and $-V_2$, respectively, of the control circuit of FIG. 8.

The control circuit includes a low pass filter, indicated generally by reference numeral 115, for removing noise from the current of the ram motor 46 and an amplifier 116 for amplifying this current as it is fed to the microprocessor 126.

FIG. 8D shows the battery charger for recharging the batteries 74, which comprises a battery charger controller 130 (MAX713CSE) connected to a relay $R_L$, which disconnects the control circuit from the batteries 74 while the batteries 74 are being charged.

The battery charge controller 130 also controls the switching of the LED 111 for indicating when charging is taking place.

The operation of the control circuit will now be described with reference to the flow chart of FIGS. 9A and 9B.

Figure 9A:
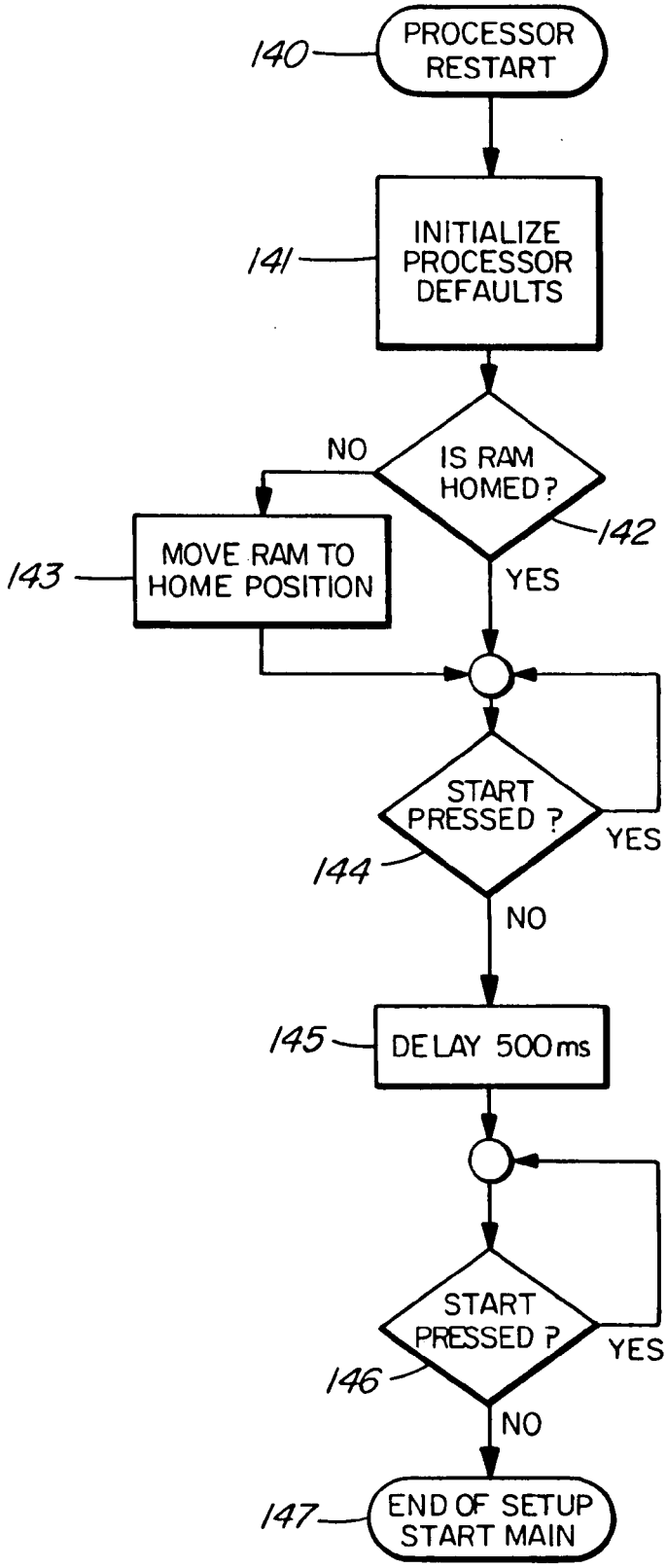
FIG. 9 shows a flow diagram of the operation of the control circuit.
Figure 9B:
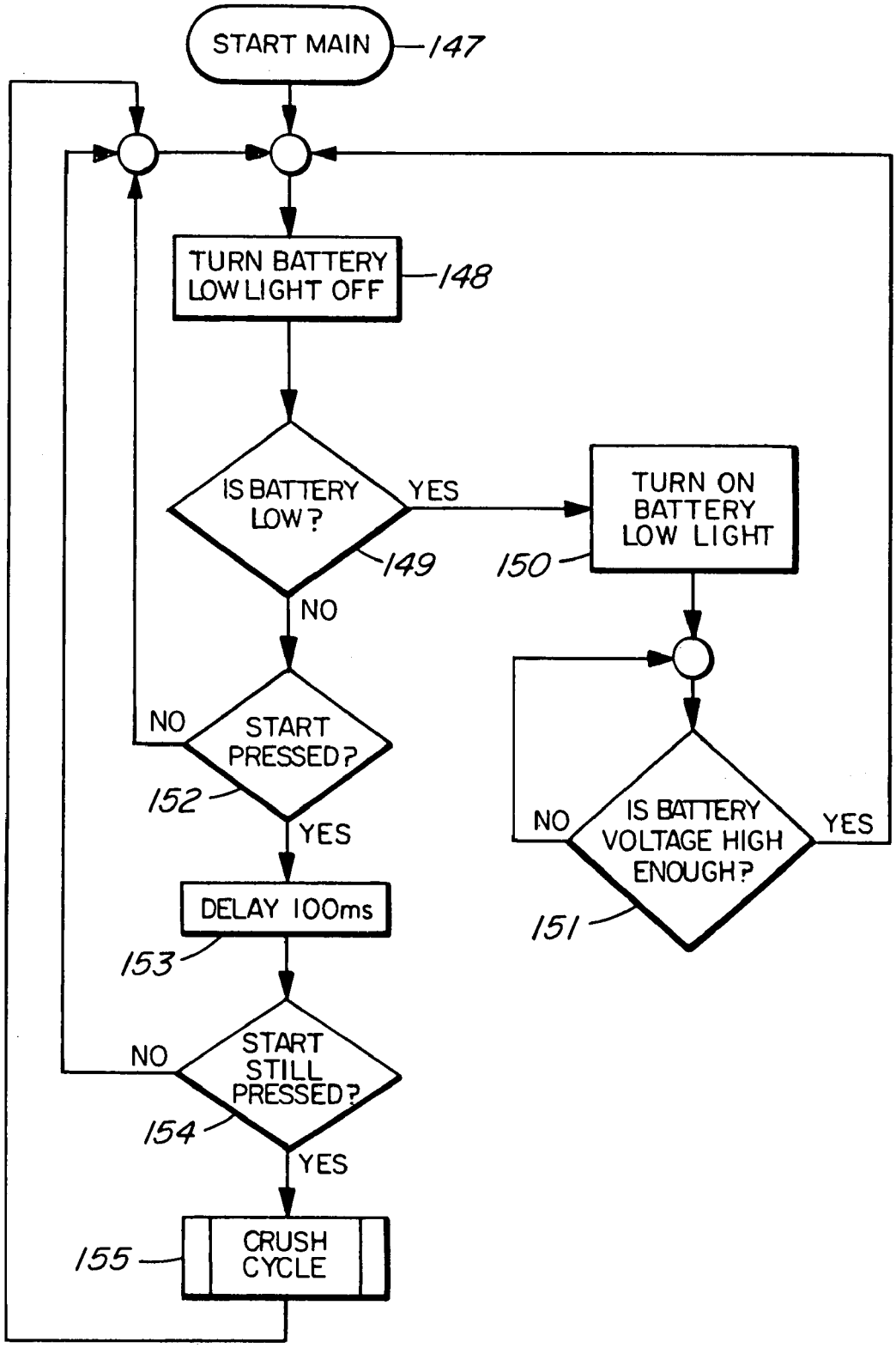

FIG. 9A shows the starting of the microcontroller 126. Following Processor restart 140, the defaults of the microcontroller 126 are initialized in Initialize processor defaults 141.

Step 142 determines whether the ram 64 is in its home position, i.e. spaced from the anvil member 80 as shown in FIG. 3, and if not, then the ram 64 is moved into its home position is step 143.

When the ram 64 is in its home position, in which the ram 64 closes a switch $SW_2$, the microcontroller 126 determines in step 144 whether the start button 114 has been released, thereby opening switch $SW_2$, in order to ensure that the user does not have the start button pressed during start-up or to ensure that there is no switch fault. If the start button 114 has been released, and after a delay of 500 ms in step 145, the microprocessor again determines in step 146 whether the start button 114 has been released. If so, then the set up operation is completed in step 147, and the operation illustrated in FIG. 9B is initiated.

The microprocessor 126 then, in step 148, switches off the battery low light LED 116 and in step 149 determines whether the battery power is low. If so, then in step 150 the battery low light LED 116 is again switched on and in step 151 the microprocessor 126 determines whether the battery voltage is sufficiently high, in which case steps 148 and 149 are repeated. In step 152 the microprocessor 126 determines whether the start button 114 is pressed, thereby closing the switch $SW_1$. After a delay of 100 ms in step 153, the microcontroller 126 again determines instep 154 whether the start button 114 is pressed, in which case the microprocessor 126 initiates the movement of the ram 64 to crush the pill in step 155.

I claim:

1. A pill crusher, comprising:

an anvil member;

a ram;

the ram and the anvil member having opposed pill crushing faces normally separated by a gap;

a ram drive operable to displace the ram towards the anvil member;

the anvil member being rotatable and displaceable in response to pressure from the ram;

a housing containing the anvil member, the ram and the ram drive;

the housing having a pill pouch reception opening providing access for the pill pouch to the gap between the opposed pill crushing faces; and a waste outlet passage extending downwardly from the housing from the pill crushing face of the anvil member.

2. A pill crusher as claimed in claim 1, wherein the pill pouch reception opening is upwardly open and extends above the crushing face of the anvil member.

3. A pill crusher as claimed in claim 1, wherein the ram drive comprises an electric motor and a lead screw rotatable by the electric motor, the lead screw being in threaded engagement with the ram.

4. A pill crusher as claimed in claim 3, including means for restraining the ram from rotation about the lead screw and allowing displacement of the ram along the lead screw in response to rotation of the lead screw.

5. A pill crusher as claimed in claim 1, including a holder in which the anvil member is mounted, a spring urging the anvil member towards the ram and a cam connection between the holder and the anvil member for effecting the rotation of the anvil member on displacement of the anvil member against the action of the spring by the pressure of the ram.

6. A pill crusher as claimed in claim 1, wherein the housing has a top portion and opposite side portions extending downwardly from the side portions and wherein the pill pouch reception opening comprises a slot extending across the top portion of the housing and downwardly from the top portion of the housing into the opposite side portions of the housing.

7. A pill crusher, comprising:

an anvil member;

a ram;

the ram and the anvil member having opposed pill crushing faces normally separated by a gap;

a ram drive operable to displace the ram towards the anvil member, wherein the ram drive comprises an electric motor and a lead screw rotatable by the electric motor, the lead screw being in threaded engagement with the ram;

the anvil member being rotatable and displaceable in response to pressure from the ram;

a housing containing the anvil member, the ram and the ram drive;

the housing having a pill pouch reception opening providing access for the pill pouch to the gap between the opposed pill crushing faces; and wherein the housing has a top portion and opposite side portions extending downwardly from the side portions and wherein the pill pouch reception opening comprises a slot extending across the top portion of the housing and downwardly from the top portion of the housing into the opposite side portions of the housing.

8. A pill crusher as claimed in claim 7, wherein the pill pouch reception opening is upwardly open and extends above the crushing face of the anvil member.

9. A pill crusher as claimed in claim 7, including means for restraining the ram from rotation about the lead screw and allowing displacement of the ram along the lead screw in response to rotation of the lead screw.

10. A pill crusher as claimed in claim 7, including a waste outlet passage extending downwardly from the housing from the pill crushing face of the anvil member.

11. A pill crusher as claimed in claim 7, including a holder in which the anvil member is mounted, a spring urging the anvil member towards the ram and a cam connection between the holder and the anvil member for effecting the rotation of the anvil member on displacement of the anvil member against the action of the spring by the pressure of the ram.

* * * * *